US010248145B2

(12) United States Patent
Ciomaga et al.

(10) Patent No.: US 10,248,145 B2
(45) Date of Patent: Apr. 2, 2019

(54) VOLTAGE REGULATOR WITH DRIVE VOLTAGE DEPENDENT ON REFERENCE VOLTAGE

(71) Applicant: Dialog Semiconductor (UK) Limited, London (GB)

(72) Inventors: Dan Ciomaga, Ingolstadt (DE); Mihail Jefremow, Augsburg (DE); Stephan Drebinger, Munich (DE); Fabio Rigoni, Karlsfeld (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/901,233

(22) Filed: Feb. 21, 2018

(65) Prior Publication Data

US 2018/0239380 A1 Aug. 23, 2018

(30) Foreign Application Priority Data

Feb. 21, 2017 (DE) ..... 10 2017 202 807

(51) Int. Cl.
*G05F 1/575* (2006.01)
*G05F 1/46* (2006.01)

(52) U.S. Cl.
CPC ..... *G05F 1/575* (2013.01); *G05F 1/468* (2013.01)

(58) Field of Classification Search
CPC . G05F 1/56; G05F 1/563; G05F 1/567; G05F 1/575; G05F 1/577; H02M 3/156–3/158; H02M 3/1588; H02M 2001/007; H02M 2001/009; H02M 2001/0032; H02M 2001/0045; Y02B 70/1466
USPC ..... 323/266, 273, 280–285
See application file for complete search history.

(56) References Cited

U.S. PATENT DOCUMENTS

| | | | | |
|---|---|---|---|---|
| 7,208,925 | B2 * | 4/2007 | Rose | H02M 1/32 323/225 |
| 7,602,162 | B2 * | 10/2009 | Bansal | G05F 1/573 323/277 |
| 2013/0002213 | A1 * | 1/2013 | Khare | G05F 1/563 323/266 |
| 2013/0147447 | A1 * | 6/2013 | Liu | G05F 1/575 323/273 |
| 2017/0205841 | A1 * | 7/2017 | Jefremow | G05F 1/575 |

* cited by examiner

*Primary Examiner* — Yemane Mehari
(74) *Attorney, Agent, or Firm* — Saile Ackerman LLC; Stephen B. Ackerman

(57) ABSTRACT

A voltage regulator to provide a load current at an output node is presented. The voltage regulator has a pass transistor for providing the load current at the output node from an input node. The voltage regulator contains a driver stage to set a gate voltage at a gate of the pass transistor based on a drive voltage at a gate of a drive transistor. The voltage regulator has voltage regulation means to set the drive voltage in dependence of an indication of the output voltage at the output node and in dependence of a reference voltage for the output voltage. The driver stage has the drive transistor and a diode transistor, wherein the diode transistor forms a current mirror with the pass transistor. The driver stage has a current amplifier amplifies a drive current through the drive transistor to provide an amplified current through the diode transistor.

24 Claims, 8 Drawing Sheets

VOLTAGE REGULATOR WITH DRIVE VOLTAGE DEPENDENT ON REFERENCE VOLTAGE

TECHNICAL FIELD

The present document relates to a voltage regulator. In particular, the present document relates to a voltage regulator having improved load transient behaviour.

BACKGROUND

Voltage regulators are frequently used for providing a load current at a stable load voltage to different types of loads (e.g. to the processors of an electronic device). A voltage regulator derives the load current from an input node of the regulator, while regulating the output voltage at the output node of the regulator in accordance to a reference voltage. In this context, the voltage regulator should be able to react rapidly to changes of the load current at the output node of the regulator.

SUMMARY

The present document addresses the technical problem of providing a power efficient voltage regulator with a fast and stable reaction to load transients. According to an aspect, a voltage regulator configured to provide at an output node a load current at an output voltage is described. The voltage regulator comprises a pass transistor for providing the load current at the output node from an input node. Furthermore, the voltage regulator comprises a driver stage configured to set a gate voltage at a gate of the pass transistor based on a drive voltage at a gate of a drive transistor. In addition, the voltage regulator comprises voltage regulation means configured to set the drive voltage in dependence of an indication of the output voltage at the output node and in dependence of a reference voltage for the output voltage. The driver stage comprises the drive transistor and a diode transistor, wherein the diode transistor forms a current mirror with the pass transistor. Furthermore, the driver stage comprises a current amplifier which is configured to amplify a drive current through the drive transistor to provide an amplified current through the diode transistor, wherein the drive current is dependent on the drive voltage.

According to a further aspect, a method for providing at an output node of a regulator a load current at an output voltage is described. The voltage regulator comprises a pass transistor for providing the load current at the output node from an input node. The method comprises setting the load current through the pass transistor based on a drive voltage at a gate of a drive transistor, wherein setting the gate voltage comprises amplifying a drive current through the drive transistor to provide an amplified current through a diode transistor which forms a current mirror with the pass transistor. The drive current is dependent on the drive voltage. Furthermore, the method comprises setting the drive voltage in dependence of an indication of the output voltage at the output node and in dependence of a reference voltage for the output voltage.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
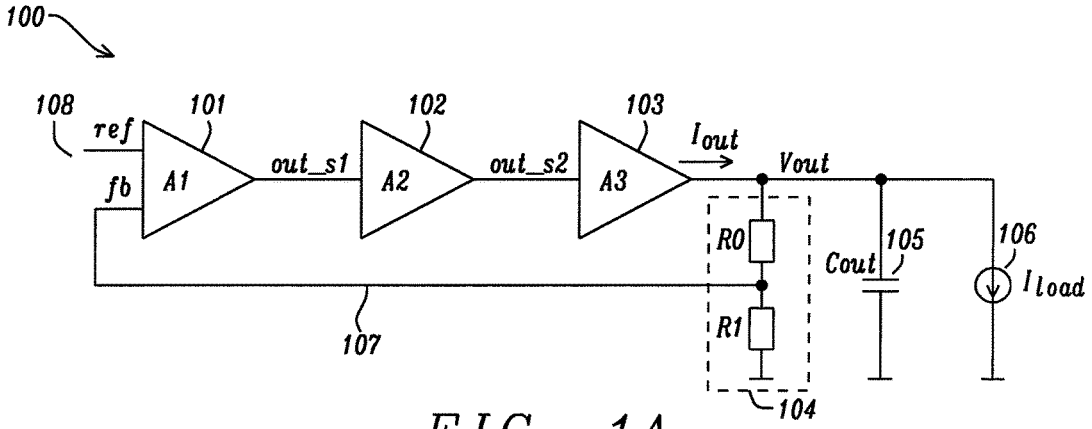
FIG. 1A illustrates an example block diagram of an LDO regulator.

As outlined above, the present document is directed at providing a power efficient voltage regulator with a stable and fast reaction to load transients. An example of a voltage regulator is an LDO regulator. A typical LDO regulator 100 is illustrated in FIG. 1*a*. The LDO regulator 100 comprises an output amplification stage 103, comprising e.g. a field-effect transistor (FET), at the output and a differential amplification stage 101 (also referred to as error amplifier) at the input. A first input (fb) 107 of the differential amplification stage 101 receives a fraction of the output voltage $V_{out}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. to the power FET, changes by a feedback mechanism called main feedback loop to maintain a constant output voltage $V_{out}$.

The LDO regulator 100 of FIG. 1A further comprises an additional intermediate amplification stage 102 configured to amplify the output voltage of the differential amplification stage 101. An intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bypass capacitor) 105 parallel to the load 106. The output capacitor 105 is used to stabilize the output voltage $V_{out}$ subject to a change of the load 106, in particular subject to a change of the requested load current $I_{load}$.

Figure 1B:
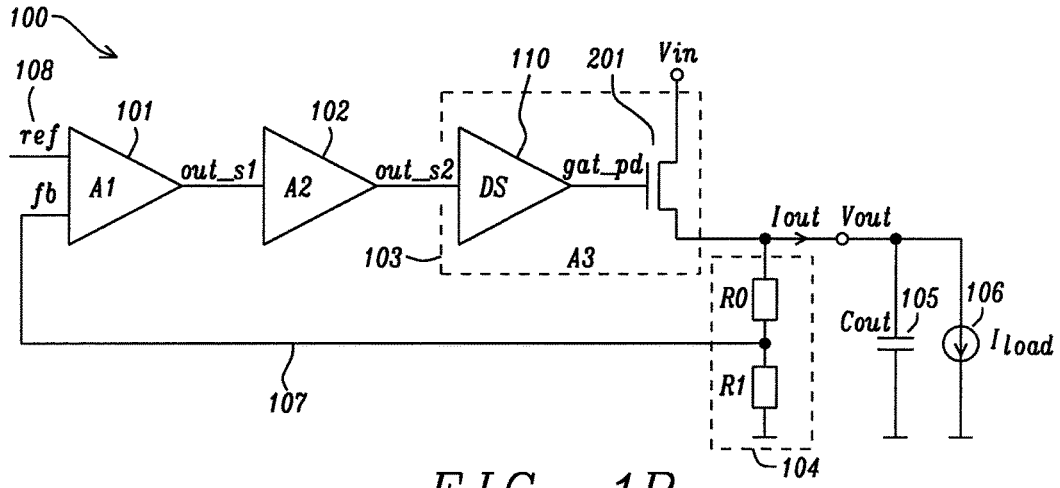
FIG. 1B illustrates the example block diagram of an LDO regulator in more detail.

FIG. 1B illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 3V, an output voltage of 2V, and an output current or load current ranging from 1 mA to 100 or 200 mA. Other configurations are possible.

Almost every modern power management IC (integrated circuit) incorporates a variety of different low dropout regulators (LDO regulator) 100 to provide stable and accurately regulated supply rails. The LDO regulator 100 drops the input voltage by the pass transistor 201 to Vout to provide a regulated supply, i.e. a regulated output voltage, which is free of any noise. With steadily increasing demand for more accurately regulated supply rails, the load transient performance of voltage regulators 100 becomes increasingly important.

Figure 2A:
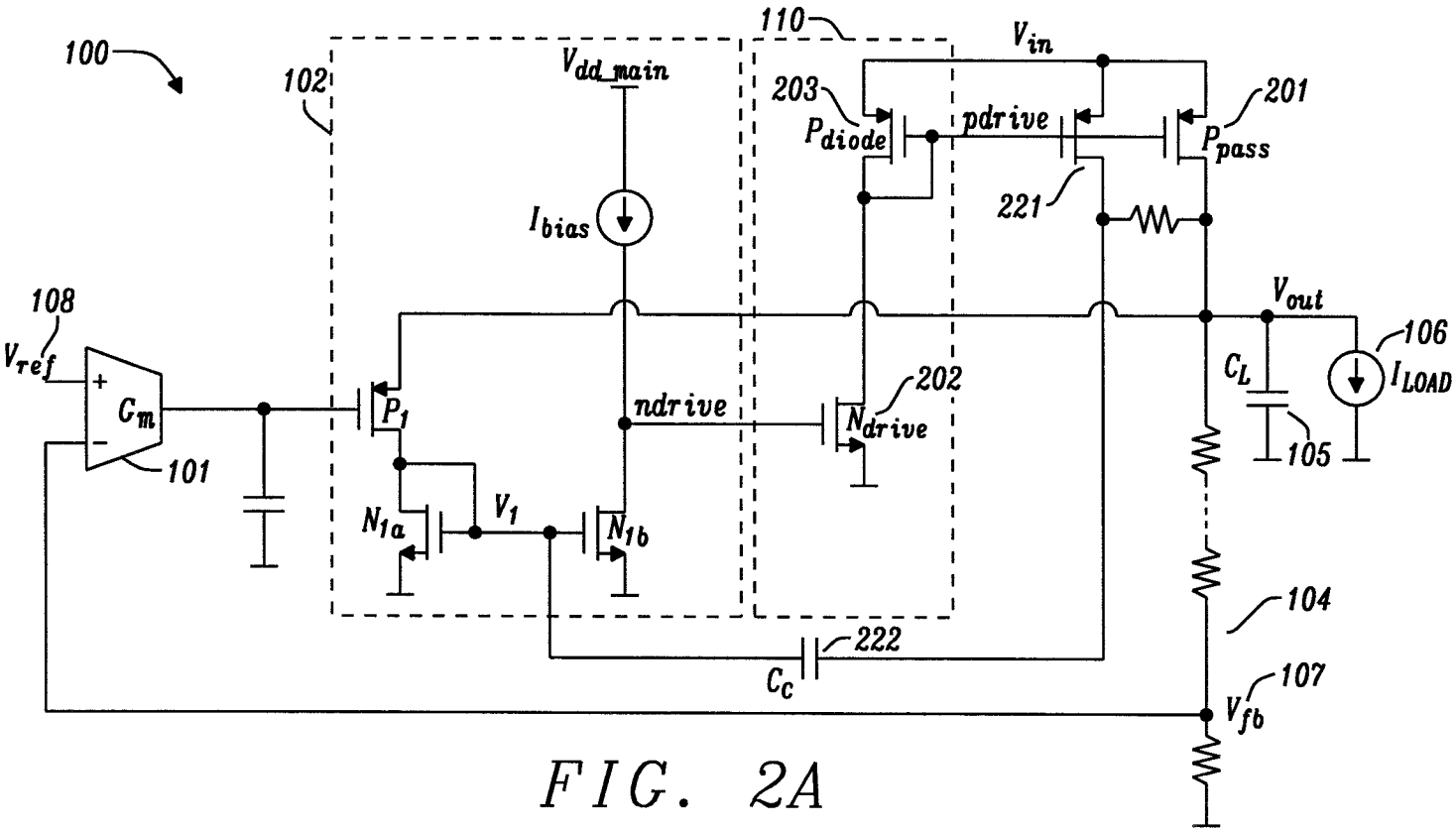
FIG. 2A illustrates an example PMOS voltage regulator.

FIG. 2A shows an example PMOS (i.e. p-type metaloxide semiconductor, MOS) LDO regulator 100. The first stage 101 of the regulator 100 is symbolically depicted as a generic transconductance. Furthermore, the regulator 100 comprises a driver stage 110 which comprises an NMOS (i.e. n-type MOS) transistor 202 called Ndrive and referred to herein as drive transistor. The gate of the drive transistor 202 is driven by the ndrive node which is the output of the second amplification stage 102. Furthermore, the driver stage 110 comprises a PMOS diode called Pdiode and referred to herein as diode transistor 203. The drive transistor 202 and the diode transistor 203 together form a common source stage that generates the pdrive signal, i.e. the gate voltage, driving the pass transistor 201 of the regulator 100, namely Ppass.

Typically and notably for high load current regulators 100, the driver stage 110 may carry substantial currents, at high current loads, due to stability requirements. Because of this, the Ndrive transistor 202 typically needs to be sized appropriately, meaning the drive transistor 202 typically exhibits a relative large size, so as to not degrade dropout performance. This has the drawback that the relatively large drive transistor 202 capacitively loads the high impedance node ndrive. In other words, the relatively large gate capacitance of the drive transistor 202 is coupled to the output node ndrive of the second amplification stage 102. This has a negative impact on the reaction speed to load transients.

The regulator 100 of FIG. 2A also comprises a feedback capacitance 222 which provides a feedback signal to the second amplification stage 102 based on the load current (via the transistor 221) and/or based on the output voltage (via the resistance at the drain of the pass transistor 201).

Figure 2B:
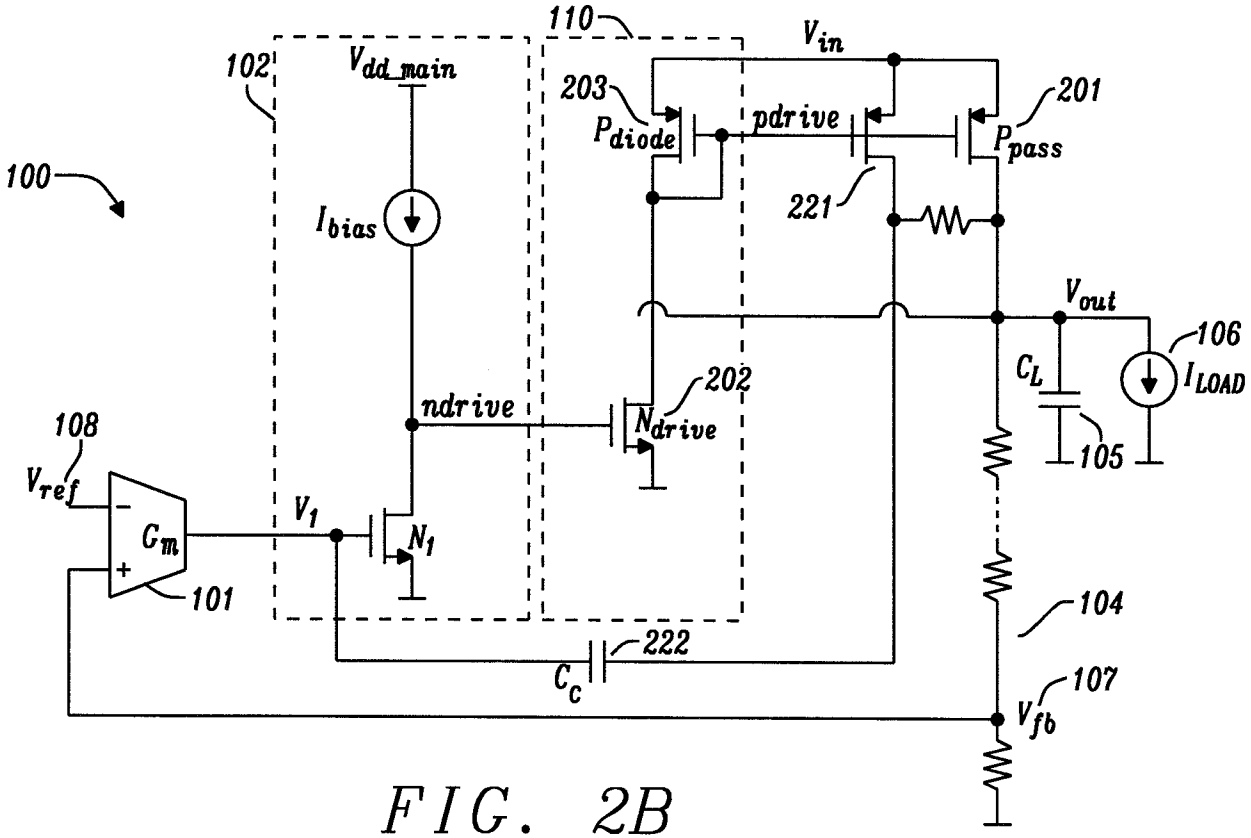
FIG. 2B shows a further example PMOS voltage regulator.

FIG. 2B shows a further example regulator 100. The regulator 100 of FIG. 2B uses the same driver stage 110 as the regulator 100 of FIG. 2A to drive the pass transistor 201 and therefore the regulator 100 of FIG. 2B suffers from the same load transient degradation as described above.

Figure 3:
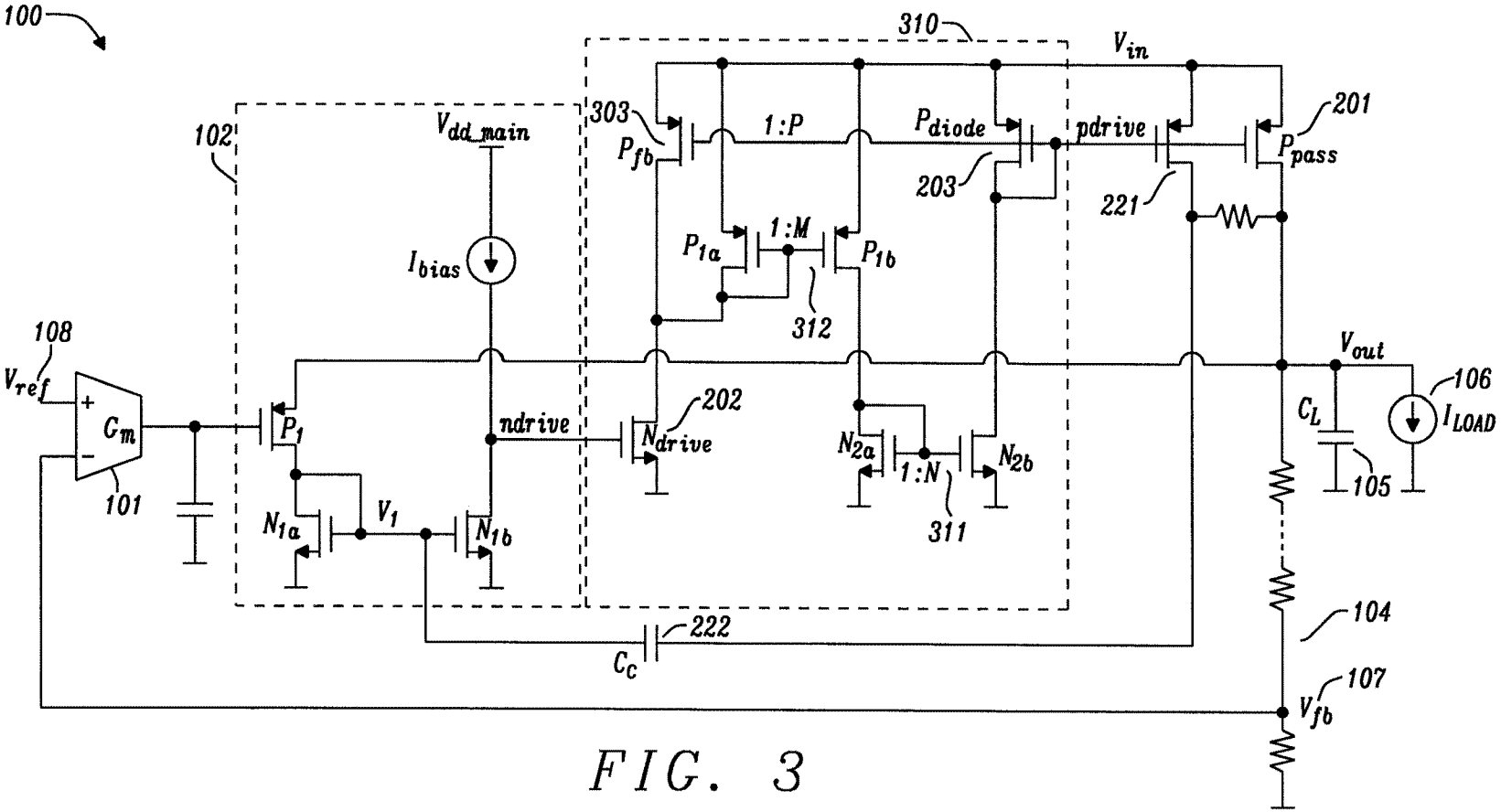
FIG. 3 shows an example PMOS voltage regulator with a current mode buffer and a current mode feedback.
Figure 4:
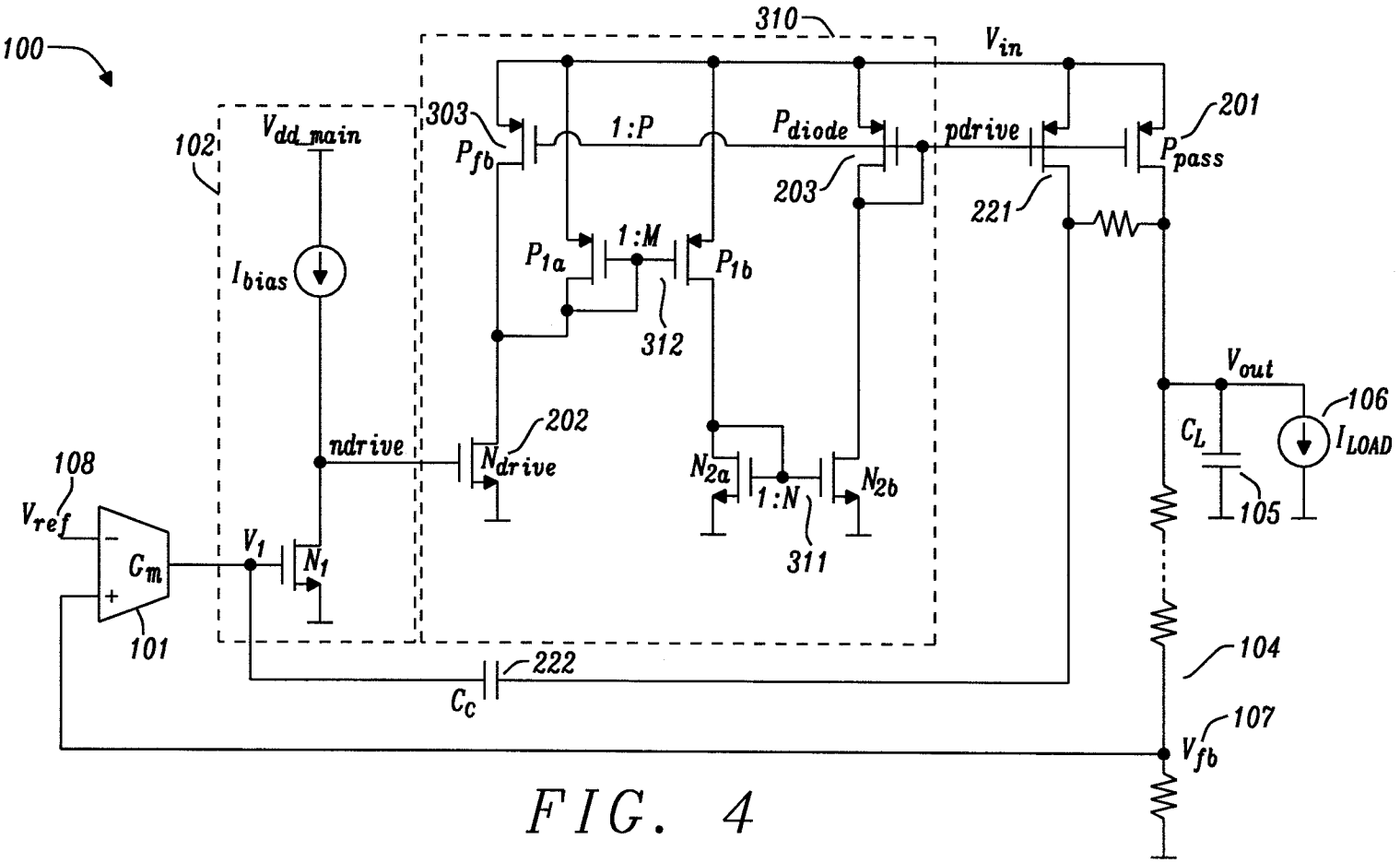
FIG. 4 shows a further example PMOS voltage regulator with a current mode buffer and a current mode feedback.

FIGS. 3 and 4 show voltage regulators 100 which exhibit improved load transient behavior while keeping stability and current consumption unaffected.

FIG. 3 shows the regulator 100 of FIG. 2A incorporating an improved driver stage 310 for load transient improvement. The driver stage 310 comprises a two stage current mode amplifier 311, 312. In particular, the driver stage 310 comprises a p-type current mirror 312 P1*a*-P1*b* and an n-type current mirror 311 N2*a*-N2*b*. Surrounding the current amplifier 311, 312 a one stage current mode feedback 203, 303 is placed, wherein the current mode feedback 203, 303 comprises a current mirror formed by a feedback transistor Pfb 303 and the diode transistor Pdiode 203. The voltage associated with the pdrive node, i.e. with the gate of the diode transistor 203, is used to drive the gate of the pass transistor Ppass 201. As such, the driver stage 310 comprises a current mode amplifier 311, 312 with feedback 203, 303.

The current gain of the driver stage 310 from the drain current of the Ndrive node, seen as input, to the drain current of the diode transistor Pdiode 203, seen as output, is $A=(M\cdot N)/(1+(M\cdot N)/P)$, where M·N is identified as being the forward current gain and 1/P as being the reverse current gain. M, N and P are the geometric ratios of the above mentioned current mirrors 311 (N), 312 (M) and 203, 303 (P), as shown in FIG. 3.

The current gain A, assuming A>1, may be used to downsize the drive transistor Ndrive 202 by the factor A. As a result of this, the capacitive loading of the high impedance node ndrive, i.e. the gate of the drive transistor 202, is decreased by the factor A. This leads to an improved load transient performance and to an extra budget for stability due to a frequency increase of the pole associated with node ndrive.

A further benefit of employing the driver stage 310 for load transient behavior can be seen when considering the way in which the regulator 100 reacts to the following event. A load induced disturbance at the output of the regulator 100 is propagated by the transistor P1 through the current mirror N1*a*-N1*b* of the amplification stage 102 to the node ndrive (which exhibits a reduced capacitance). Due to the fact that the node ndrive has an increase speed, the signal travels through the forward path of the driver stage 310, thereby benefiting from the entire M·N forward gain to generate the correction signal on the node pdrive that forces the pass transistor 201 Ppass to source current as required by the load 106. By the time the local feedback 203, 303 within the driver stage 310, namely the feedback transistor Pfb 303, reacts to correct its own disturbance generated by the drive transistor Ndrive 202, it can be assumed that the regulator 100 has already responded to the load transient event. Hence, as far as a load transient is concerned, the benefit of using the driver stage 310 is two-fold, one in terms of speed (due to reduced capacitance on the ndrive node) and another in terms of gain (due to the M·N forward gain of the current mirrors 311, 312).

FIG. 4 shows a further example regulator comprising the improved driver stage 310.

Figure 5A:
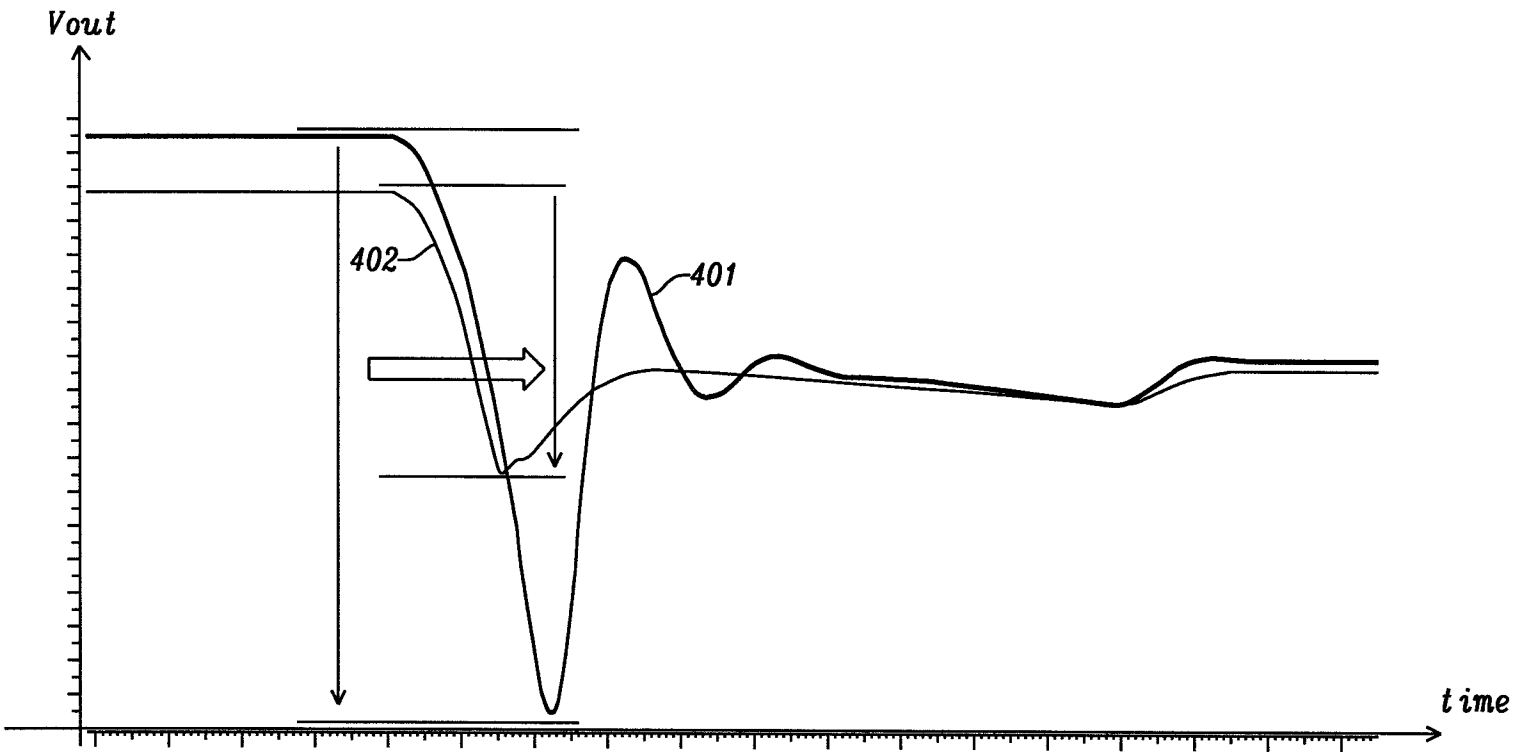
FIGS. 5A and 5B show performance data for the PMOS voltage regulator of FIG. 3.
Figure 5B:
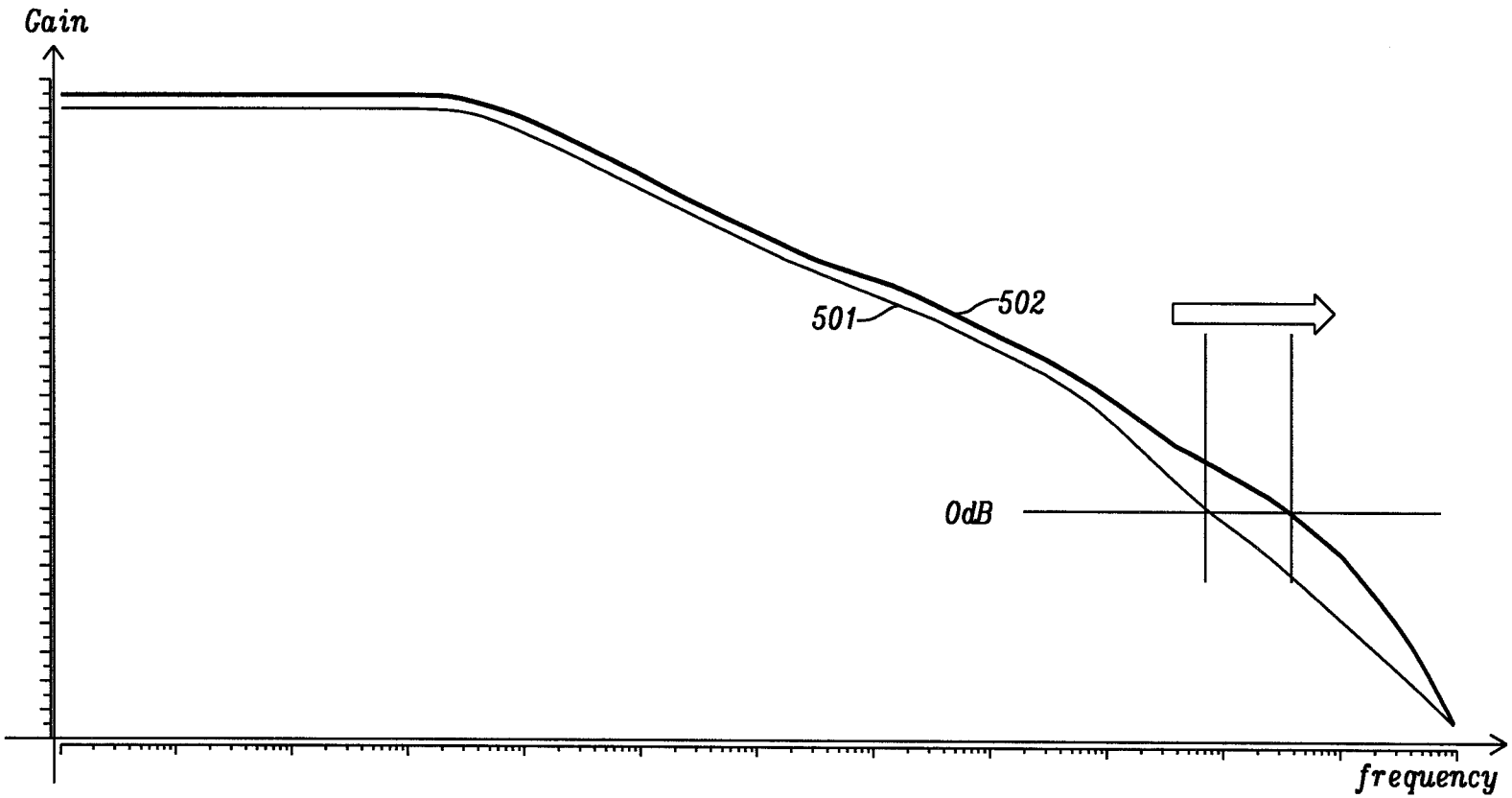

FIG. 5A shows the output voltage $V_{out}$ of a regulator 100 in response to a load transient (from zero load to maximum load). In particular, FIG. 5A shows the output voltage 401 of the regulator 100 of FIG. 2A and the output voltage 402 of the regulator 100 of FIG. 3. A 50% performance improvement may be observed when using the improved driver stage 310. Furthermore, FIG. 5B shows the open loop gain of the regulators 100 of FIG. 2A (curve 501) and of the regulator 100 of FIG. 3 (curve 502). A significant improvement in gain-bandwidth can be observed when using the improved driver stage 310.

As such, a regulator 100 (notably a voltage regulator such as a linear dropout regulator) is described. The regulator 100 is configured to provide at an output node of the regulator 100 a load current at an output voltage. The output node of the regulator 100 may be coupled to a load (e.g. to a processor) which is to be operated using the load current.

The regulator 100 (notably the voltage regulator) comprises a pass transistor 201 (e.g. an p-type metal oxide semiconductor transistor) for providing the load current at the output node from an input node. The input node may correspond to a source of the pass transistor 201 and the output node may correspond to a drain of the pass transistor 201. Furthermore, the regulator 100 comprises a driver stage 310 which is configured to set a gate voltage at a gate of the pass transistor 201 and/or to set the load current through the pass transistor 201 based on a drive current and/or based on a drive voltage.

The driver stage 310 may comprise a diode transistor 203 (e.g. a PMOS transistor) having a gate that is coupled to the gate of the pass transistor 201, having a source that is coupled to the source of the pass transistor 201, and having a drain that is coupled to the gate of the diode transistor 203. As such, the diode transistor 203 may form a current mirror with the pass transistor 201. The drive voltage may correspond to the voltage at a gate of a drive transistor 202 and the drive current may correspond to the current through the drive transistor 202 of the driver stage 310. The drive transistor 202 may be a n-type metaloxide semiconductor transistor.

The regulator 100 may further comprise voltage regulation means 104, 101, 102 (or an outer feedback loop) which are configured to set the drive voltage and/or the drive current in dependence of an indication of the output voltage at the output node and in dependence of a reference voltage 108 for the output voltage.

The voltage regulation means 104, 101, 102 may comprise feedback means 104 (e.g. a voltage divider) for deriving a feedback voltage 107 from the output voltage at the output node. Furthermore, the voltage regulator means 104, 101, 102 may comprise a differential amplifier 101, 102 configured to derive the drive voltage and/or the drive current in dependence of the feedback voltage 107 and in dependence of the reference voltage 108, notably in dependence of a difference between the feedback voltage 107 and the reference voltage 108.

Furthermore, the voltage regulator 100 may comprise a feedback capacitor 222 configured to provide a feedback signal to the voltage regulation means 104, 101, 102, wherein the feedback signal is dependent on the load current and/or on the output voltage. By using a feedback capacitor 222, the stability of the voltage regulator 100 may be increased.

The driver stage 310 comprises the drive transistor 202 (at the input of the driver stage 310) and the diode transistor 203 (at the output of the driver stage 310). Furthermore, the driver stage 310 comprises a current amplifier 311, 312 which is configured to amplify a drive current through the drive transistor 202 to provide an amplified current through the diode transistor 203. The drive current is dependent on the drive voltage. In particular, the drive current through the drive transistor 202 may be adjusted in dependence of the drive voltage at the gate of the drive transistor 202.

By providing a driver stage 310 with a current amplifier 311, 312, the size of the drive transistor 202 may be decreased, thereby decreasing the gate capacitance of the drive transistor 202. As a result of this, the reaction speed of the regulator 100 subject to load transients may be increased.

The driver stage 310 may comprise a current feedback loop 203, 303 configured to derive a feedback current from the current through the diode transistor 203. The feedback current is fed back such that the feedback current affects the drive current. In particular, a negative feedback may be provided, i.e. the feedback loop 203, 303 may be configured to reduce the drive current using the feedback current. By providing a (negative) feedback loop 203, 303, the stability of the driver stage 310 may be increased.

The feedback loop 203, 303 may exhibit a feedback gain P such that the feedback current is P times smaller than the current through the diode transistor 203. By way of example, the current feedback loop 203, 303 may comprise a feedback transistor 303 which forms a current mirror with the diode transistor 203, wherein the feedback transistor 303 is arranged in series with the drive transistor 202. In particular, the serial arrangement of feedback transistor 303 and drive transistor 202 may be arranged between the input node and ground.

The current amplifier 311, 312 of the driver stage 310 may comprise at least one current mirror. In particular, the current amplifier 311, 312 may comprise a first current mirror 312 having a first forward gain M and a second current mirror 311 having a second forward gain N. The first current mirror 312 and the second current mirror 311 may be cascaded such that the current amplifier 311, 312 exhibits a (overall) forward gain M·N. In combination with the feedback loop 203, 303, an overall gain $A=(M\cdot N)/(1\pm(M\cdot N)/P)$ may be obtained for the driver stage 310 (between the drive voltage at the input and the gate voltage at the gate of the pass transistor 201 at the output of the driver stage 310). As such, the driver stage 310 may be tuned to the required level of the load current by adjusting the forward gains N, M and the feedback gain P.

The drive transistor 202 may be arranged in series with the feedback transistor 303, such that the drive current flows through the drive transistor 202 and the feedback transistor 303. An input node of the current amplifier 311, 312 (notably an input node of the first current mirror 312) may be coupled to the midpoint between the drive transistor 202 and the feedback transistor. Furthermore, the current amplifier 311, 312 (notably the second current mirror 311) may comprise an output transistor $N_{2b}$ which is arranged in series with the diode transistor 203, such that the current through the output transistor $N_{2b}$ is equal to the current through the diode transistor 203. The serial arrangement of the output transistor $N_{2b}$ and the diode transistor 203 may be arranged between the input node and ground. As such, the current through the diode transistor 203 may be derived in an efficient manner.

Figure 6:
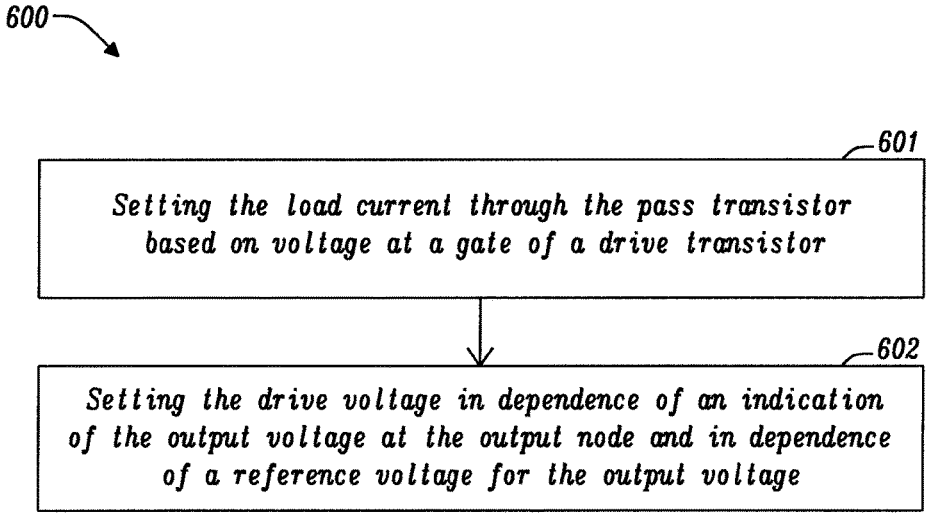
FIG. 6 shows a flow chart of an example method for providing a load current at an output node of a regulator.

FIG. 6 shows a flow chart of an example method 600 for providing at an output node of a regulator 100 a load current at an output voltage. The voltage regulator 100 comprises a pass transistor 201 for providing the load current at the output node from an input node. The method 600 comprises setting 601 the load current through the pass transistor 201 based on a drive voltage at a gate of a drive transistor 202. Setting the gate voltage may comprise amplifying a drive current through the drive transistor 202 to provide an amplified current through a diode transistor 203 which forms a current mirror with the pass transistor 201. The drive current may be derived in dependence of the drive voltage. The method 600 further comprises setting 602 the drive voltage in dependence of an indication of the output voltage at the output node and in dependence of a reference voltage 108 for the output voltage.

As such, a voltage regulator 100 with improved load transient behavior is described, while keeping stability and current consumption of the voltage regulator 100 unaffected. Furthermore, the described regulator 100 shows improved PSRR (power supply rejection ratio) performance at the supply rail of the pass transistor 201. In addition, the described regulator 100 may achieve unchanged load transient performance with reduced current consumption.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A voltage regulator configured to provide at an output node a load current at an output voltage, wherein the voltage regulator comprises, a pass transistor for providing the load current at the output node from an input node;

a driver stage configured to set a gate voltage at a gate of the pass transistor based on a drive voltage at a gate of a drive transistor;

voltage regulation means configured to set the drive voltage in dependence of an indication of the output voltage at the output node and in dependence of a reference voltage for the output voltage; wherein the driver stage comprises the drive transistor and a diode transistor; wherein the diode transistor forms a current mirror with the pass transistor; and a current amplifier which is configured to amplify a drive current through the drive transistor to provide an amplified current through the diode transistor; wherein the drive current is dependent on the drive voltage, and wherein the current amplifier comprises a first current mirror having a first forward gain M; and a second current mirror having a second forward gain N, such that the current amplifier exhibits a forward gain M·N.

2. The voltage regulator of claim 1, wherein the driver stage comprises a current feedback loop configured to derive a feedback current from the current through the diode transistor; wherein the feedback current affects the drive current.

3. The voltage regulator of claim 2, wherein the feedback loop exhibits a feedback gain P such that the feedback current is P times smaller than the current through the diode transistor.

4. The voltage regulator of claim 2, wherein the feedback loop is configured to reduce the drive current using the feedback current.

5. The voltage regulator of claim 2, wherein the current feedback loop comprises a feedback transistor which forms a current mirror with the diode transistor; and the feedback transistor is arranged in series with the drive transistor between the input node and ground.

6. The voltage regulator of claim 1, wherein the current amplifier comprises a current mirror.

7. The voltage regulator of claim 1, wherein the driver stage exhibits an overall gain $A=(M\cdot N)/(1+(M\cdot N)/P)$.

8. The voltage regulator of claim 1, wherein the drive transistor is arranged in series with a feedback transistor, such that the drive current flows through the drive transistor and the feedback transistor; and an input node of the current amplifier is coupled to a midpoint between the drive transistor and the feedback transistor.

9. The voltage regulator of claim 1, wherein the current amplifier comprises an output transistor which is arranged in series with the diode transistor, such that the current through the output transistor is equal to the current through the diode transistor.

10. The voltage regulator of claim 1, wherein the pass transistor is a p-type metaloxide semiconductor transistor;

the diode transistor is a p-type metaloxide semiconductor transistor; and the drive transistor is a n-type metaloxide semiconductor transistor.

11. The voltage regulator of claim 1, wherein the voltage regulation means comprises:

feedback means for deriving a feedback voltage from the output voltage at the output node; and a differential amplifier configured to derive the drive voltage in dependence of the feedback voltage and in dependence of the reference voltage.

12. The voltage regulator of claim 1, wherein the voltage regulator further comprises a feedback capacitor configured to provide a feedback signal to the voltage regulation means; wherein the feedback signal is dependent on the load current and/or the output voltage.

13. A method for providing at an output node of a regulator a load current at an output voltage, wherein the voltage regulator comprises a pass transistor for providing the load current at the output node from an input node; wherein the method comprises the steps of:

setting the load current through the pass transistor based on a drive voltage at a gate of a drive transistor; wherein setting the gate voltage comprises amplifying a drive current through the drive transistor to provide an amplified current through a diode transistor which forms a current mirror with the pass transistor; wherein the drive current is dependent on the drive voltage; and setting the drive voltage in dependence of an indication of the output voltage at the output node and in dependence of a reference voltage for the output voltage, wherein the current amplifier comprises a first current mirror having a first forward gain M; and a second current mirror having a second forward gain N, such that the current amplifier exhibits a forward gain M·N.

14. The method of claim 13, wherein the driver stage comprises a current feedback loop to derive a feedback current from the current through the diode transistor; wherein the feedback current affects the drive current.

15. The method of claim 14, wherein the feedback loop exhibits a feedback gain P such that the feedback current is P times smaller than the current through the diode transistor.

16. The method of claim 14, wherein the feedback loop reduces the drive current using the feedback current.

17. The method of claim 14, wherein the current feedback loop comprises a feedback transistor which forms a current mirror with the diode transistor; and the feedback transistor is arranged in series with the drive transistor between the input node and ground.

18. The method of claim 13, wherein the current amplifier comprises a current mirror.

19. The method of claim 13, wherein the driver stage exhibits an overall gain $A=(M\cdot N)/(1+(M\cdot N)/P)$.

20. The method of claim 13, wherein the drive transistor is arranged in series with a feedback transistor, such that the drive current flows through the drive transistor and the feedback transistor; and an input node of the current amplifier is coupled to a midpoint between the drive transistor and the feedback transistor.

21. The method of claim 13, wherein the current amplifier comprises an output transistor which is arranged in series with the diode transistor, such that the current through the output transistor is equal to the current through the diode transistor.

22. The method of claim 13, wherein the pass transistor is a p-type metaloxide semiconductor transistor;

the diode transistor is a p-type metaloxide semiconductor transistor; and the drive transistor is a n-type metaloxide semiconductor transistor.

23. The method of claim 13, wherein the voltage regulation means comprises:

feedback means for deriving a feedback voltage from the output voltage at the output node; and a differential amplifier to derive the drive voltage in dependence of the feedback voltage and in dependence of the reference voltage.

24. The method of claim 13, wherein the voltage regulator further comprises a feedback capacitor to provide a feedback signal to the voltage regulation means; wherein the feedback signal is dependent on the load current and/or the output voltage.

* * * * *